US008701903B2

(12) United States Patent
Müller

(10) Patent No.: US 8,701,903 B2
(45) Date of Patent: Apr. 22, 2014

(54) TRACTION ROD FOR BRACING A CRANE JIB

(75) Inventor: Thomas Müller, Rheinberg (DE)

(73) Assignee: V & M Deutschland GmbH, Düsseldorf (DE)

( * ) Notice: Subject to any disclaimer, the term of this patent is extended or adjusted under 35 U.S.C. 154(b) by 0 days.

(21) Appl. No.: 13/148,794

(22) PCT Filed: Feb. 5, 2010

(86) PCT No.: PCT/DE2010/000180

§ 371 (c)(1), (2), (4) Date: Oct. 17, 2011

(87) PCT Pub. No.: WO2010/091678

PCT Pub. Date: Aug. 19, 2010

(65) Prior Publication Data

US 2012/0037584 A1 Feb. 16, 2012

(30) Foreign Application Priority Data

Feb. 11, 2009 (DE) ..... 10 2009 008 809

(51) Int. Cl.
*B66C 23/62* (2006.01)

(52) U.S. Cl.
USPC ..... 212/292; 403/119

(58) Field of Classification Search
USPC ..... 403/119, 305; 212/271, 292; 464/137, 464/138, 50, 86, 182
See application file for complete search history.

(56) References Cited

U.S. PATENT DOCUMENTS 3,865,173 A * 2/1975 Rohrberg ..... 164/46
6,814,523 B1 * 11/2004 Nilsson ..... 403/305

FOREIGN PATENT DOCUMENTS

| | | |
|---|---|---|
| DE | 202008006167 | 7/2008 |
| EP | 0733584 | 9/1996 |
| EP | 1213254 | 6/2002 |

* cited by examiner

*Primary Examiner* — Emmanuel M Marcelo
*Assistant Examiner* — Angela Caligiuri
(74) *Attorney, Agent, or Firm* — Henry M. Feiereisen LLC

(57) ABSTRACT

The invention relates to a traction rod (1) for bracing a crane jib, comprising a metallic tubular body (2) and coupling elements (3) which are connected to both ends thereof for an articulated connection of the traction rods among each other by means of bolts (5). According to the invention, the tubular body and the coupling elements consist of a one-piece tube portion, wherein the coupling elements are designed in each case as a thicker zone of the wall of the ends of the tubular body and are dimensioned in such a manner that a weakening of the cross section of the nominal wall thickness of the coupling elements, which has to be considered for calculating the load capacity of the tubular body, is prevented in the region of the bolt connection and the transition regions (7) from the respective thicker zones of the wall in the direction of the tubular body have a transition free of starting points for increasing fatigue strength.

4 Claims, 2 Drawing Sheets

TRACTION ROD FOR BRACING A CRANE JIB

CROSS-REFERENCES TO RELATED APPLICATIONS

This application is the U.S. National Stage of International Application No. PCT/DE2010/000180, filed Feb. 5, 2010, which designated the United States and has been published as International Publication No. WO 2010/091678 and which claims the priority of German Patent Application, Serial No. 10 2009 008 809.1, filed Feb. 11, 2009, pursuant to 35 U.S.C. 119(a)-(d).

BACKGROUND OF THE INVENTION

The invention relates to a traction rod for bracing a crane jib.

Cranes with crane jibs are disclosed, for example, in DE 20 2008 006 167 U1. The crane jibs can hereby be braced with rope-shaped elements or with tubular elements connected with one another in an articulated manner.

It is known to construct rod-shaped elements embodied as traction rods from tube sections having forked-shaped end pieces welded to the ends as coupling elements. The individual traction rods are then coupled to one another at the fork-shaped end pieces in an articulated manner with a bolt connection to produce the required length.

Such cranes which may be constructed, for example, as lattice boom cranes are subjected during operation to high dynamic stress, which also has an effect on the traction rods of the bracing.

Disadvantageously, the weld connections between tube and coupling element of welded traction rods have an increased sensitivity to notches and are therefore at risk for increased fatigue crack formation in the region of the weld seam. The fatigue strength of such traction rods is thereby significantly reduced, resulting in high costs due to the risk for early failures.

It is an object of the invention to provide a traction rod for bracing a crane jib which does not exhibit the aforedescribed disadvantages and can be produced cost-effectively.

SUMMARY OF THE INVENTION

According to the teaching of the invention, the tubular body and the coupling elements are constructed from a one-piece tube section, wherein each of the coupling elements is implemented as a wall thickening of an end of the tubular body, wherein the ends are sized so as to prevent weakening in the cross-section of the nominal wall thickness of the coupling elements in the region of the bolt connection, which has to be taken into account when calculating the load bearing capacity of the tubular body, and wherein the transition regions of the respective wall thickening to the tubular body include a projection-free transition for increasing the fatigue strength.

According to the invention, the wall thickening can be attained with an enlarged outside diameter and/or with a reduced inside diameter.

The advantage of the traction rod according to the invention is, on one hand, that the manufacture is significantly more cost-effective due to the one-part construction and, on the other hand, a significantly improved fatigue strength of the traction rod is attained as a result of the calculated full load-bearing capacity of the tube cross-section in the region of the bolt connection.

In a first advantageous variant of the method according to the invention, the wall thickening is produced by upsetting, in particular by hot upsetting of the tube end.

Advantageously, the upsetting process is performed so that the transitions from the tube to the coupling element generated during upsetting are produced without shoulders and with the lowest possible number of notches. To this end, the transitions have the greatest possible radius. Optionally, these transitions can also be produced by mechanical machining.

The transitions formed in this way result in a continuous and notch-free transition to the region of the tube that is not thickened. This advantageously ensures a low stress concentration factor in the transition zone.

According to another advantageous embodiment of the invention, the wall of the tube end can also be thickened by an overlay weld or by sintering, followed by mechanical machining.

In the aforementioned variants of the method, producing the wall thickening is completely decoupled from the rolling process. In this way, tubes, for example tubes held in inventory which were originally not intended for the described application, can be provided with a wall thickening and subjected to a corresponding mechanical machining process at a later time.

The tube ends may already be thickened during manufacture of the hot-rolled seamless tube, if this were considered to be advantageous from a production standpoint. For example, a larger outside diameter is produced by moving the rollers apart at the tube ends, while an enlarged inside diameter is produced, for example, with a suitably constructed interior tool.

Advantageous features, advantages and details of the invention are described in the following description of exemplary embodiments.

DETAILED DESCRIPTION OF PREFERRED EMBODIMENTS

Figure 1:
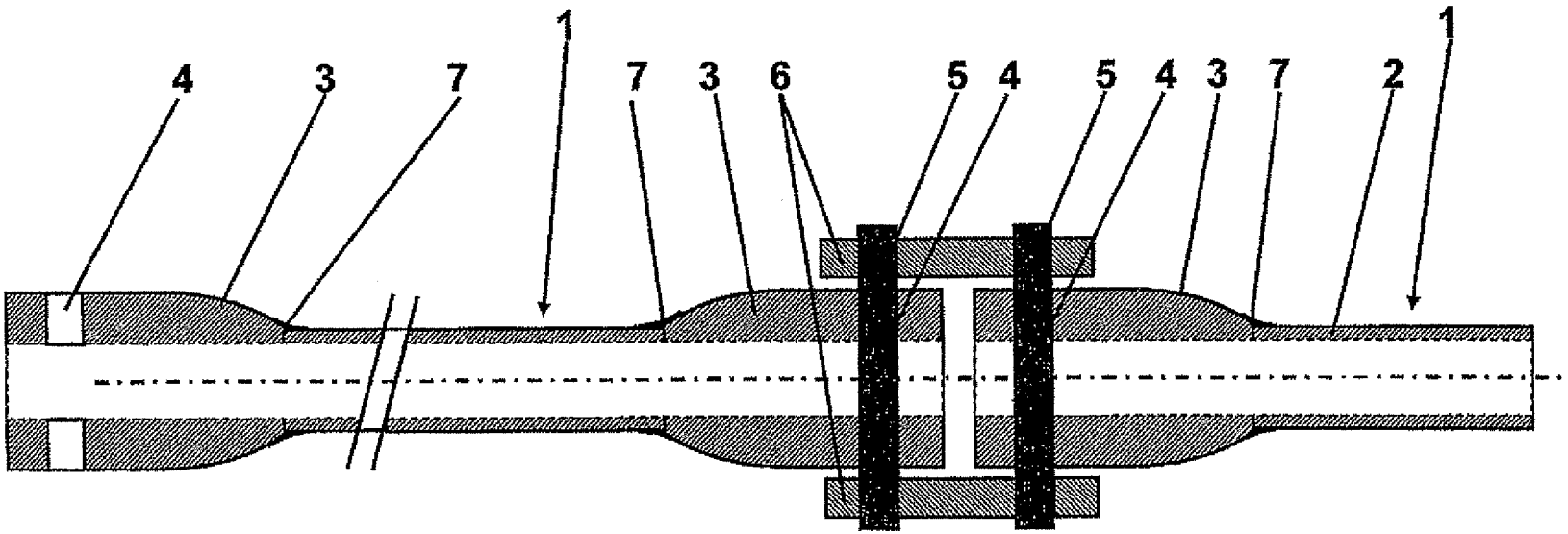
FIG. 1 shows the respective ends of a traction rod according to the invention with wall thickening realized with an enlarged outside diameter.
Figure 2:
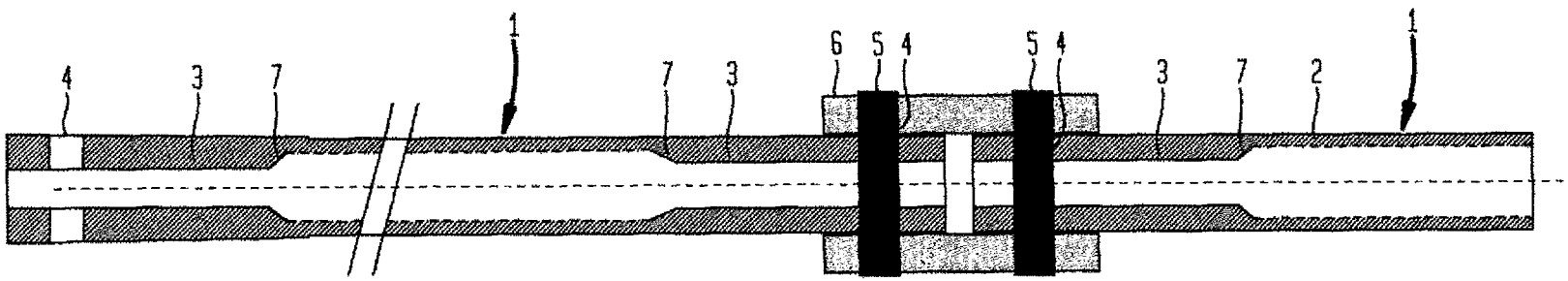
FIG. 2 shows the respective ends of a traction rod according to the invention with wail thickening realized with a reduced inside diameter.

The traction rod 1 has a tubular body 2 with coupling elements 3 disposed at its ends, wherein the coupling elements 3 are implemented, according to the invention, as a wall thickening of the tube. In this example, the wall thickening is realized with an enlarged outside diameter; however, the wall thickening can also be realized with a reduced inside diameter.

According to the invention, the transitions 7 from the wall thickening to the tubular body 2 are implemented without a projection and with a low number of notches in order to attain a highest possible fatigue strength of the traction rod in operation.

Each of the coupling elements 3 has a bore 4, so that the traction rods can be connected with one another in an articulated chain-like manner. To this end, extra-long bolts 5 are inserted into the bores 4 so that the ends protruding from both sides of the coupling element 3 can be connected with safety tabs 6 and thus secured against detachment.

The invention claimed is:

1. An articulated connection of a first traction rod to a second traction rod for bracing a crane jib, each of the first and second traction rods comprising a metallic tubular body having a longitudinal extent and at least one end, wherein the at least one end transitions into a tubular coupling element being implemented as a wall thickening of the at least one end of the tubular body, wherein a transition region from the wall thickening to the tubular body is constructed to be free of projections, and a safety tab extending longitudinally at least partially externally along the tubular coupling element, and a bolt extending transversely through both the safety tab and an opening in the tubular coupling element, wherein the tubular body and the coupling element are constructed as a one-piece continuous tubular section, with the coupling element being dimensioned so as to prevent cross-sectional weakening of a nominal wall thickness of the coupling element in a region of the bolt connection to be taken into account when calculating a load bearing capacity of the tubular body.

2. The articulated connection of claim 1, wherein the wall thickening represents an enlarged outside diameter of the tubular body or a reduced inside diameter of the tubular body, or both.

3. The articulated connection of claim 2, wherein the wall thickening is produced by hot upsetting.

4. The articulated connection of claim 1, wherein the wall thickening is produced from an overlay weld.

* * * * *